US005927042A

United States Patent [19]

Last

[11] Patent Number: 5,927,042

[45] Date of Patent: Jul. 27, 1999

[54] COMPOSITE BEAM ENCLOSURE STRUCTURE

[76] Inventor: Harry J. Last, 122 Dunecrest Ave., Monterey, Calif. 93940

[21] Appl. No.: 08/900,082

[22] Filed: Jul. 24, 1997

[51] Int. Cl.[6] ..... E04H 4/14

[52] U.S. Cl. ..... 52/730.1; 52/731.2; 52/732.1; 52/800.12; 52/630; 52/780; 108/180; 108/157.18; 4/500; 4/502; 74/608

[58] Field of Search ..... 52/780, 790.1, 52/789.17, 793.11, 796.1, 798.1, 799.12, 799.13, 263, 261, 250, 245, 573.1, 731.1, 730.4, 732.1, 737.6, 3, 730.1, 730.6, 731.2, 731.3, 731.7, 800.12, 630; 108/180, 157.18, 153.1; 4/500, 502; 74/608

[56] References Cited

U.S. PATENT DOCUMENTS

| | | | |
|---|---|---|---|
| 2,639,876 | 5/1953 | Misfeldt . | |
| 3,501,783 | 3/1970 | Broadman . | |
| 3,603,054 | 9/1971 | Didry . | |
| 3,692,084 | 9/1972 | Irvine | 52/799.12 X |
| 3,696,578 | 10/1972 | Swensen et al. | 52/790.1 X |
| 3,716,259 | 2/1973 | Weill et al. . | |
| 3,866,381 | 2/1975 | Eschbach et al. . | |
| 3,965,942 | 6/1976 | Hatch | 52/790.1 X |
| 4,745,715 | 5/1988 | Hardwicke et al. . | |
| 4,901,490 | 2/1990 | Zinniel et al. . | |
| 4,922,670 | 5/1990 | Naka et al. . | |
| 5,156,195 | 10/1992 | Wehler et al. . | |
| 5,339,579 | 8/1994 | Woodyer et al. | 52/799.12 X |
| 5,487,930 | 1/1996 | Lockshaw et al. | 52/793.11 X |

*Primary Examiner*—Robert Canfield
*Attorney, Agent, or Firm*—Ray K. Shahani, Esq.; David E. Newhouse, Esq.

[57] ABSTRACT

A composite beam enclosure structure comprising one or more planar, rigid panel elements each having a platform with an upper surface, integral solid peripheral top and bottom and side edges, and one or more intersecting ribs standing on the bottom surface of the platform defining sectional configurations. Elongated, structural framing elements having integral opposing flanges spaced for receiving the side edges of one or more of the rigid panel elements are securely attached to the side edges of the rigid panel elements by attachment means such as screws, rivets, weld or other bond. A preferred embodiment of the composite beam enclosure structure has a front rigid panel element, an upper rigid platform element and a back rigid panel element, and the elongated structural framing elements include a first right angle, structural framing compression member coupled between the front rigid panel element and the upper rigid panel element, a second right angle, structural framing compression member coupled between the back rigid panel element and the upper rigid panel element and a flanged tension footing extending along a lower edge of the back rigid panel element. In another preferred embodiment, the sectional configuration of the front rigid panel element defines a suspended, transverse span portion between each of two lengthwise ends, the plurality of elongated structural framing elements further comprising a transverse span structural framing tension brace extending along the span portion of the front rigid panel element. Optionally, the enclosure structure further includes end plates and/or at least one mid-span bracket secured to the enclosure structure for supporting the upper rigid panel element.

10 Claims, 6 Drawing Sheets

COMPOSITE BEAM ENCLOSURE STRUCTURE

FIELD OF THE INVENTION

The present invention relates generally to composite beam structures, and more particularly to such structures formed of rigid panel members in combination with structural framing members for constructing enclosure structures having a high degree of structural rigidity or stiffness.

BACKGROUND OF THE INVENTION

Deck swimming pool covers, and the associated cover drums, cables, reels and drive systems are typically housed in a bench type enclosure positioned at one end of a swimming pool. The pool side of the enclosure is typically cut away to allow extension and retraction of the cover. Because of the location of the bench-type enclosure at one end of the swimming pool it frequently is used as a bench for a variety of purposes at the side of the pool.

Typically, a beam which is composed of two materials properly bonded together and having different moduli of elasticity is called a composite beam. Reinforced concrete beams, steel beams mechanically bonded to a concrete deck, and wood beams reinforced with steel plates are typical examples. The analysis of composite beams depends on the assumption that a plane section before bending remains plane after the load is applied. Therefore, the two materials must be connected in such a way that they will act as a unit. This condition is realized in the reinforced concrete beam by means of the bond between the reinforcing rods and the concrete. In the case of reinforced wood beams, the parts are connected by bolts properly spaced to resist the shearing forces between the plates and the beam.

Presently, however, none of these types of construction are suitable for certain applications, including swimming pool covers.

ADVANTAGES AND SUMMARY OF THE INVENTION

A composite beam enclosure structure is described including a combination of rigid panel elements with rigid structural frame elements. The enclosure has a front rigid panel element and a back rigid panel element and a top rigid panel element, the three rigid panel elements having a flat outer surface on one side of a platform with intersecting, standing rib members in a predetermined orientation and relationship with each other on the platform opposite the flat outer surface side. The rigid panel elements have flat edges around their perimeter with which the elements are coupled together with the rigid structural frame elements to form the composite beam enclosure. One or more end plates, optionally formed of additional rigid panel and structural framing elements, close the ends of the enclosure structure. The rigid panel elements are constructed so as to be modular and adaptable, to provide, in conjunction with each other and with the rigid framing elements, a broad range of sizes and shapes of rigid, enclosure structures.

The front rigid panel element is coupled to the top panel element at a 90° angle with an elongated, right angle, structural framing compression member. The back rigid panel element and the top panel element is coupled together in a similar relationship. The elongated, right angle structural framing compression members have a predetermined length and can be extruded with flanges to encase the lengthwise edges of the rigid panel elements and retain the predetermined, operative 90° orientation. A transverse span structural framing tension brace with flanges to encase the lower lengthwise edge of the front rigid panel element adds rigidity to the cantilevered span of the front rigid panel element. A flanged, tension footing encases the lower lengthwise edge of the back rigid panel element. Optionally, one or more mid-span brackets are used to support the cantilevered span.

Therefore, an advantage of the present invention is to provide an enclosure structure having one or more composite beam type spanning structural elements of considerable length.

A more particular advantage of the present invention is to provide a bench type enclosure structure for deck swimming pool covers and associated cover drum, cable, reel and drive system.

It is a further advantage of the present invention to provide such enclosure structure having an essentially rectangular footprint and bench like shape for use as furniture, recreational structure or other function.

It is a further advantage of the present invention to provide modular, high strength and highly rigid construction elements adaptable to assembly in one or more configurations.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 2A is a representative isometric detail view of a preferred embodiment of a rigid panel element 110.

FIG. 7(*a*) is a representative section view of a preferred embodiment of a portion of the composite beam enclosure structure of the present invention taken at 7—7.

FIG. 8(*a*) is a representative section view of a preferred embodiment of a mid-span bracket of the present invention taken at 8—8.

FIG. 8(*b*) is a representative section view of a preferred embodiment of a mid-span bracket in a portion of the composite beam enclosure structure of the present invention taken at 8—8.

DETAILED DESCRIPTION OF THE PREFERRED EMBODIMENT

Figure 1:
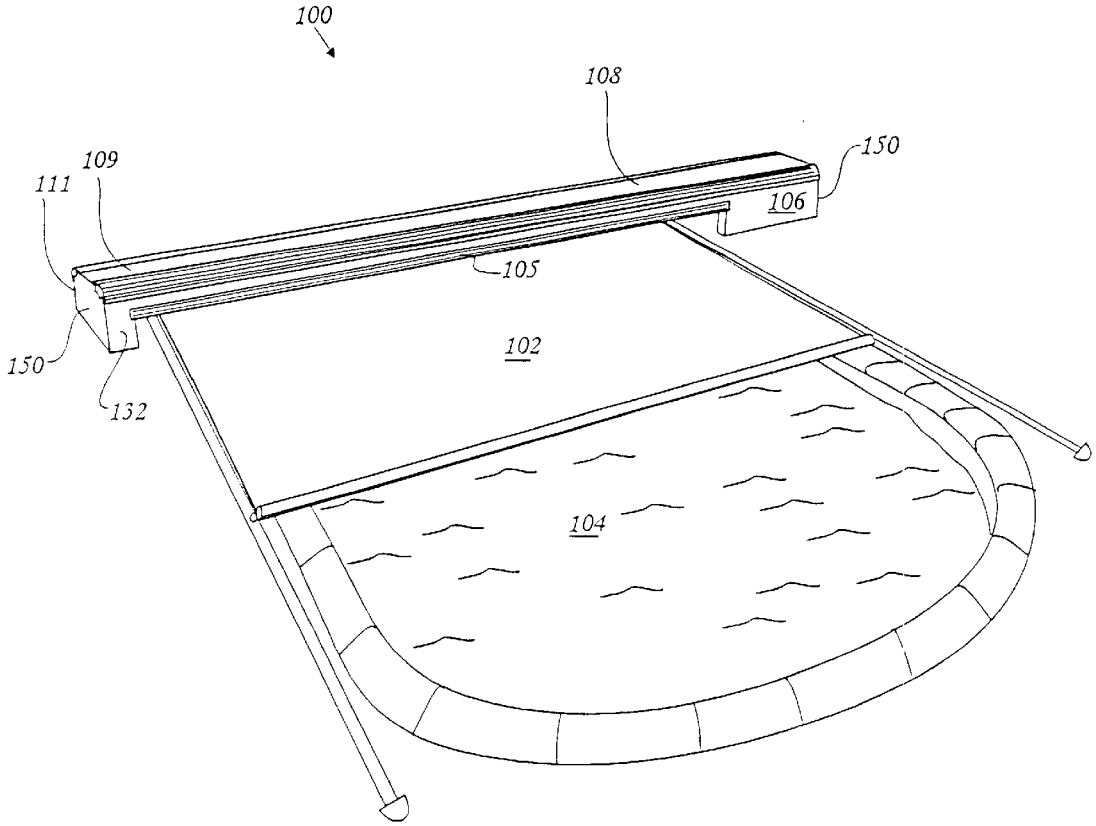
FIG. 1 is a representative view of a preferred embodiment of the composite beam enclosure structure 100 of the present invention utilized as an enclosure for a swimming pool cover 102 and associated drive assembly.

FIG. 1 is a representative view of a preferred embodiment of the composite beam enclosure structure 100 of the present invention utilized as an enclosure for a swimming pool cover 102 and associated drive assembly (not shown), including equipment, gears and machinery. The composite beam enclosure structure 100 sits at one end of a swimming pool 104 over the drive machinery of the pool cover 102. It will be understood that the front composite beam enclosure structure 100 hides the machinery of the pool cover 102 drive assembly, and that such machinery could be located at either or both sides of one or both ends of a swimming pool 104. As the pool cover 102 is rolled up, underneath the cantilevered span 105 so as to uncover the swimming pool 104, the cover drum will be enclosed by the composite beam enclosure structure 100. Additionally, a top surface 108 of the composite beam enclosure structure 100 can be used for non-enclosure purposes, such as children playing and jumping into the water, sunbathing, serving food or displaying items, etc.

Figure 2:
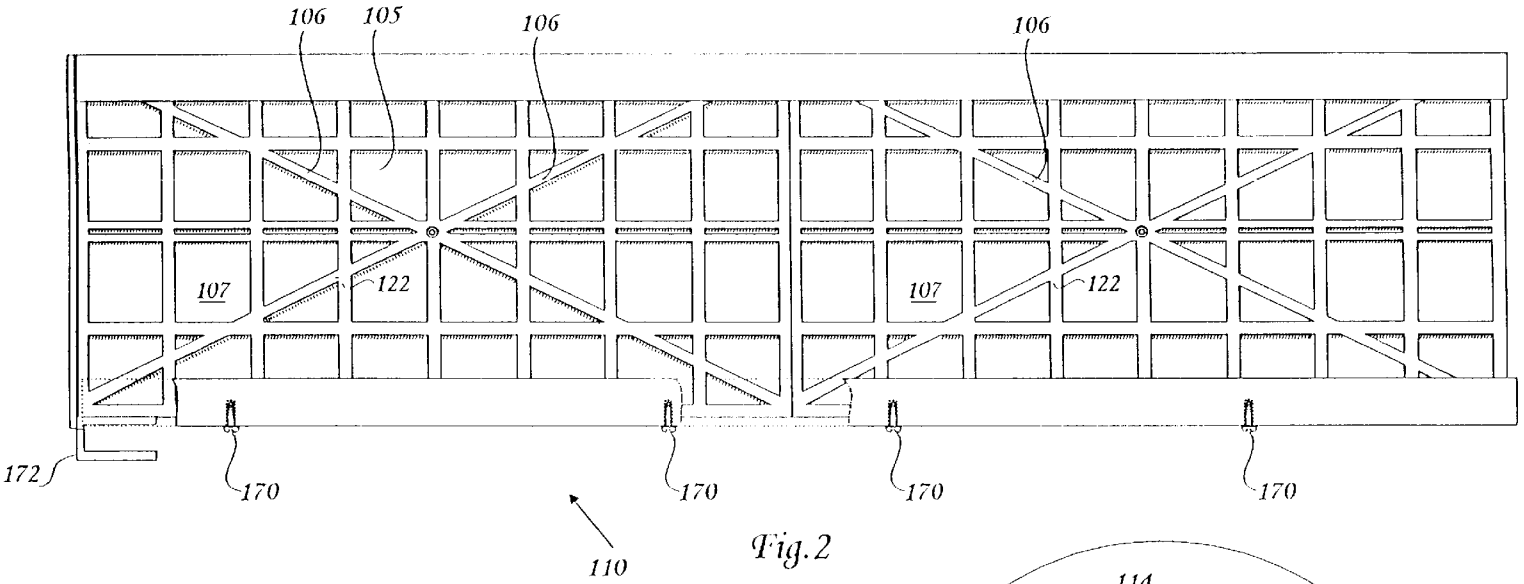
FIGS. 2 and 3 are representative views of preferred embodiments of rigid panel elements 110 of the present invention.
Figure 2:
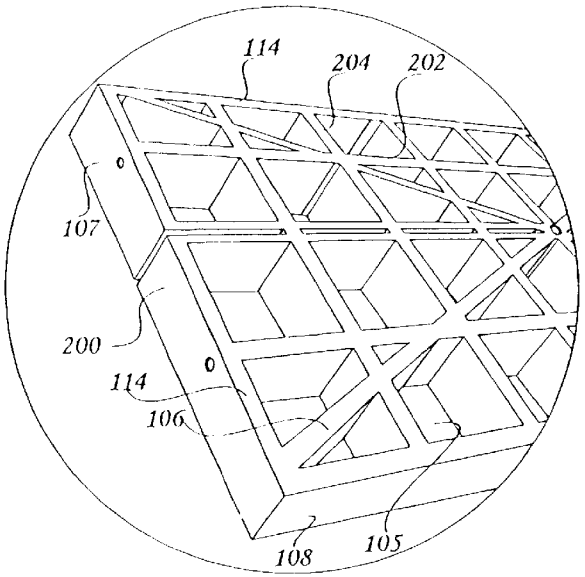
Figure 3:
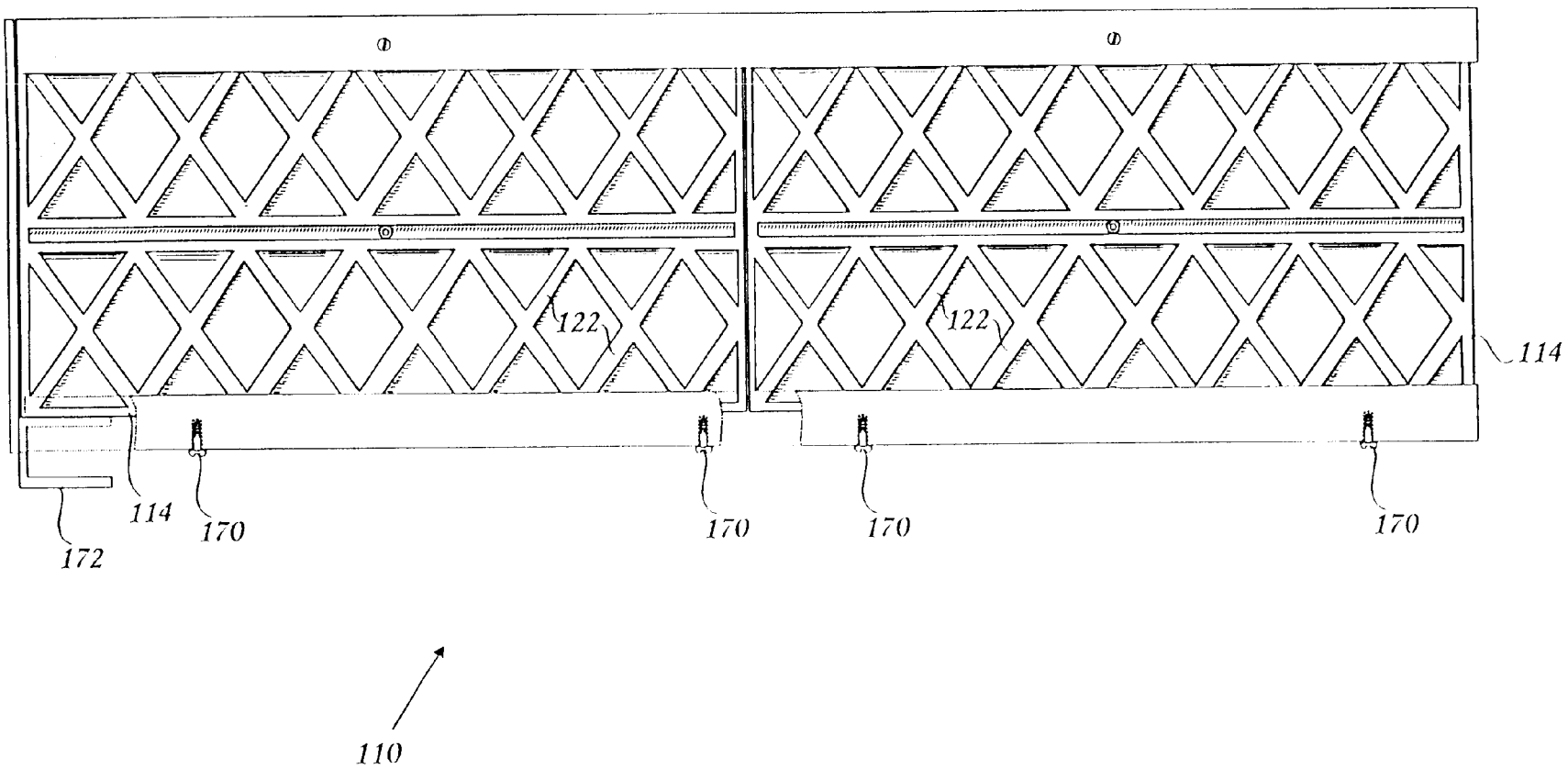

FIGS. 2 and 3 are representative views of preferred embodiments of rigid panel elements 110 of the present invention. FIG. 2A is a representative isometric detail view of a preferred embodiment of a rigid panel element 110. Each panel has a platform 107 with a top surface 108 and a bottom surface 105. A plurality of intersecting ribs 122 standing on the bottom surface 105 of the platform 107 define a rigid panel 110 with a sectional configuration and enhanced structural rigidity and stiffness in the plane of the platform 107.

FIGS. 2 and 2A show rectangular orientation of the standing ribs 122 and FIG. 3 shows triangular orientation. These examples of lattice-type three-dimensional structure are exemplary only, and are not intended to limit the scope of the present invention in any way. Other orientations and configurations of intersecting standing ribs 122 located on one or both sides of a main platform 107 are possible and will be included within the scope of the present invention. Additionally, the rigid panel elements have flat edges 114 around their perimeters which are coupled together with the peripheral structural framing elements to form the composite beam enclosure structure of the present invention. Individual mounting tabs 172 may be provided for mounting the composite beam enclosure structure 100 as desired.

A set of stiffening ribs 106 run diagonally through the horizontally and vertically configured standing ribs 122. These stiffening ribs 106 run diagonally at an angle across the lower surface 105 of the panel elements 110 and increase the stiffness and rigidity of the individual panels 110 as well as increase the stiffness and rigidity of assemblies of panel elements 110.

The thickness of the rigid panels 110 will also be determined by the height h of the standing ribs 122. A central double rib 200 extends lengthwise through a central portion of the panel 110. An additional plurality, i.e., one or more longitudinal ribs 202 extend lengthwise across platform 107, as do widthwise extending ribs 204. Furthermore, by selecting operative geometric placement of the standing ribs 122, i.e., 200, 202 and 204, the overall size and configuration can be customized. Essentially any desired portion or portions of the rigid panel, as defined by one or more lengthwise ribs 202 including central double rib 200 and one or more intersecting widthwise ribs 204, can be removed. Thus, a discrete, selected section can be removed from the rigid panel element 110 to form the cantilevered portion 105 of the rigid panel element 110. In essence, by selecting different designs for the standing ribs 122 on the platform 107, rigid panels 110 with a variety of sizes and shapes can be formed.

Furthermore, the rigid panel elements 110 are constructed so as to be modular and adaptable, to provide a broad range of varying sizes and shapes of such rigid, enclosure structures 100 of the present invention. Such rigid panel elements 110 may be formed by injection or blow molding, or other methods. The thickness of such rigid panel elements 110 can be between about 1 inch and about 6 inches or more or less, with widths of between about 1 foot and about 3 feet or more or less, and with lengths of between about 5 feet and about 10 feet or more or less. It will be understood that the views of FIGS. 2 and 3 each show two separate rigid panel elements 110 next to each other and coupled together in a linear fashion, thus providing a double-length assembly. It will be apparent to those skilled in the art that additional elements 110 can be coupled to provide a multi-element length assembly.

Figure 4A:
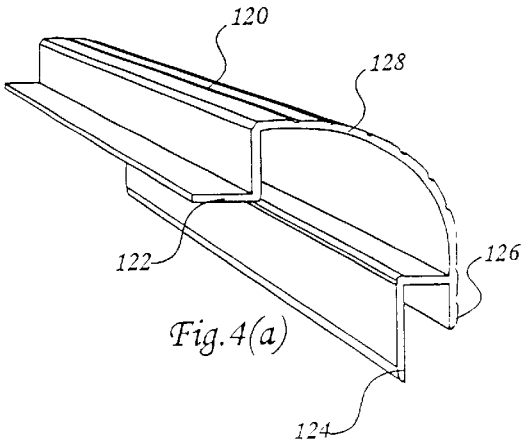
FIGS. 4A and 4B are representative isometric views of preferred embodiments of elongated, right angle structural framing compression members of the present invention.
Figure 4B:
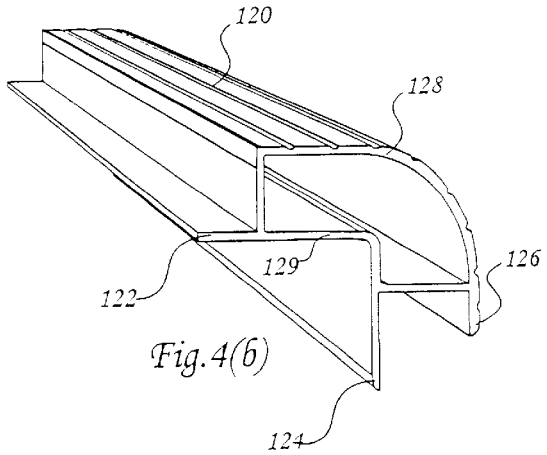

FIGS. 4A and 4B are representative section views of preferred embodiments of elongated, right angle structural framing compression members 120 of the present invention. In each of these embodiments, a horizontal lip 122 serves to support the upper rigid panel element 109 of the composite beam enclosure structure 100. Furthermore, the right angle structural framing compression member 120 also has an inside vertical flange 124 and an outside vertical flange 126, between which are intended to fit the upper edge of a front or rear rigid panel element. As described above, typically when an edge of a board or flat beam is loaded from one direction, a compressive force is developed along the edge of the beam which causes the beam to bow in the opposite direction. By coupling the upper edge of such front rigid panel element 132 or back rigid panel element 111 between the inside and the outside flanges 124 and 126, respectively, of the right angle structural framing compression member 120, any compressive forces present will be transferred from the edges of the rigid panel elements 110 to other portions of the rigid panels themselves or elsewhere within the composite beam enclosure structure, and will be prevented from deforming the loaded beam.

It will be understood that throughout the drawings of the present invention, small screws 170 are shown which will serve to couple the various components of the composite beam enclosure structure 100 together, as well as to secure the composite beam enclosure structure 100 to the ground, floor, or other basal support. Such screws 170 will also serve to secure the mid span bracket 160 to the composite beam enclosure structure 100 and to the ground. However, as will be known to those skilled in the art, such screws 170 can be replaced with compression fittings, adhesives, welds, clamps, rivets, tacks, etc., and will all be included within the scope of the present invention. As is well developed and described in the prior art, the attachment interfaces between the components of a composite beam of any type, made of at least two types of material, are very important. Individual screws, rivets or bonding surfaces may be subject to considerable shear and proper design analysis is important.

The rounded shoulder 128 of the right angle structural framing compression member 120 is a comfortable, ergonomic, non-hazardous design feature of the composite beam enclosure structure 100. Such rounded shoulder 128 provides additional resistance to deformation due to downward loading, due both to extended, suspended cantilevered spans, as well as due to loading from external forces such as children playing or people sunbathing on the composite beam enclosure structure 100. Furthermore, in the case of the embodiment shown in FIG. 4B, internal reinforcing member 129 serves to add additional strength and rigidity to the composite beam enclosure structure 100.

Figure 5:
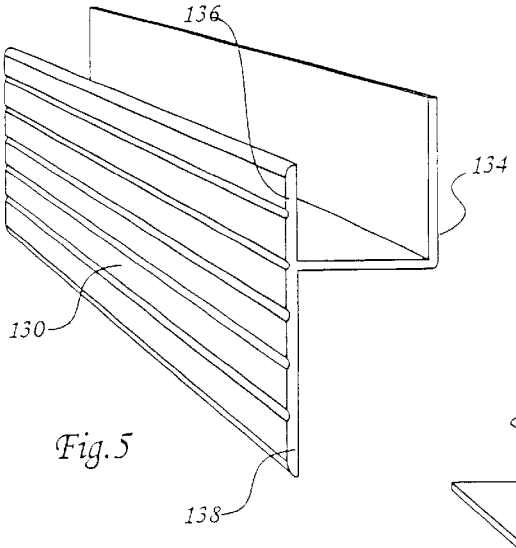
FIG. 5 is a representative isometric view of a preferred embodiment of a transverse span structural framing tension brace of the present invention.

FIG. 5 is a representative section view of a preferred embodiment of a transverse span structural framing tension brace 130 of the present invention. Span tension brace 130 fits along the lower edge of cantilevered span portion 105 of front rigid panel element 132 and is held in place by outer inside vertical flange 134 and outside vertical flange 136. Extending vertical face 138 increases and enhances the rigidity of the composite beam enclosure structure 100 by resisting deformation of the cantilevered portion 105 of front rigid panel element 132.

Figure 6:
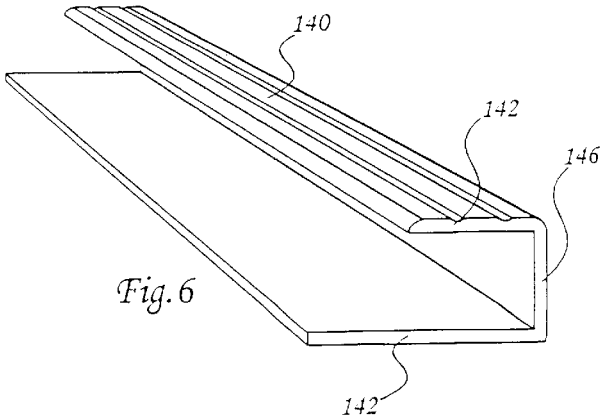
FIG. 6 is a representative isometric view of a preferred embodiment of a flanged tension footing of the present invention.

FIG. 6 is a representative section view of a preferred embodiment of a flanged tension footing 140 of the present invention. Vertical flanges 142 encase the lower edge of the back rigid panel element 111 and base plate 146 supports the composite beam enclosure structure 100. It will be understood that the flanged tension footing 140 can also be used on the lower edge of the cantilevered portion 105 of front rigid panel element 132.

Figure 7:
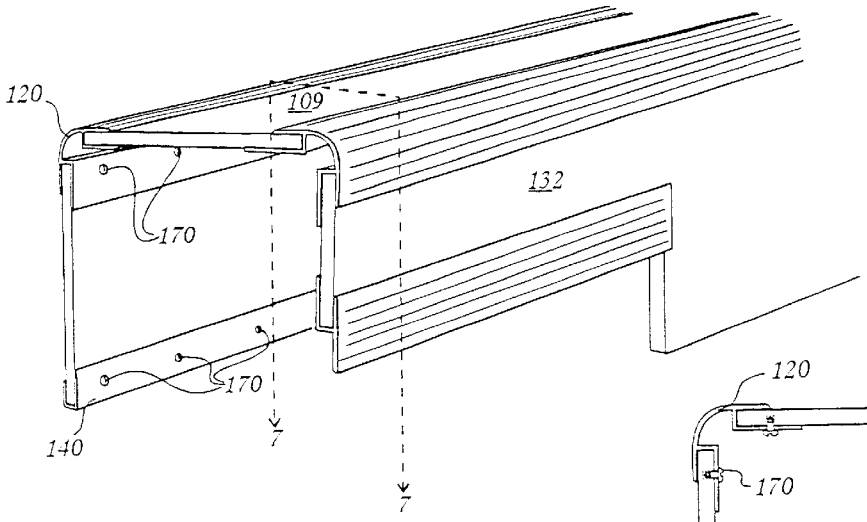
FIG. 7 is a representative isometric view of a preferred embodiment of a portion of the composite beam enclosure structure of the present invention.
Figure 7A:
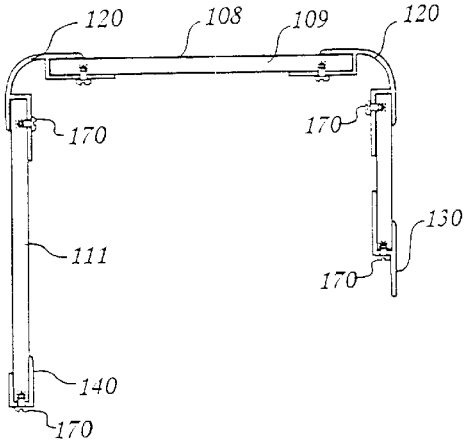
Figure 8:
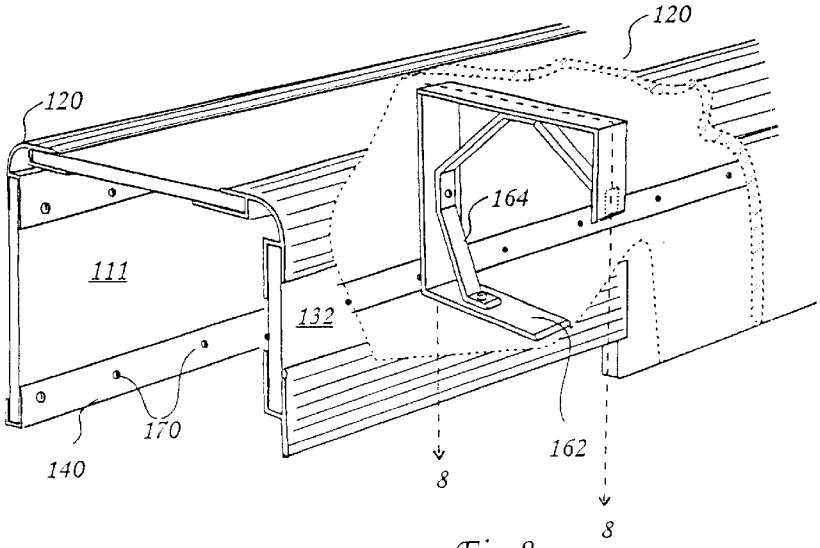
FIG. 8 is a representative isometric view of a preferred embodiment of a mid-span bracket in a portion of the composite beam enclosure structure of the present invention.
Figure 8A:
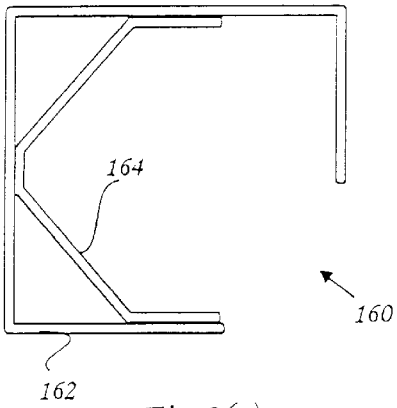
Figure 8B:
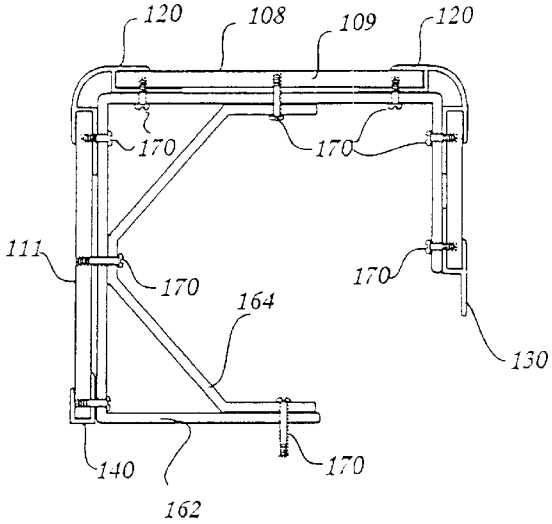

FIG. 7 is a representative isometric view of a preferred embodiment of a portion of the composite beam enclosure structure of the present invention. FIG. 7(*a*) is a representative section view of a preferred embodiment of a portion of the composite beam enclosure structure of the present invention taken at 7—7. FIG. 8 is a representative isometric view of a preferred embodiment of a mid-span bracket in a portion of the composite beam enclosure structure of the present invention. FIG. 8(*b*) is a representative section view of a preferred embodiment of a mid-span bracket in portion of the composite beam enclosure structure of the present invention taken at 8—8.

By the drawings and the foregoing, it will be understood by those skilled in the art that the front rigid panel element 132, the upper rigid panel element 109 and the back rigid panel element 111 in combination with the right angle structural framing compression members 120, transverse span structural framing tension brace 130 and flanged tension footing 140 form the principle structural elements of the composite beam enclosure structure 100. Two end plates 150, optionally formed of additional rigid panel elements, close the ends of the enclosure structure. It will be understood, additionally, that when rigid panel elements are used for the end plates 150, the composite beam enclosure structure 100 has enhanced rigidity, strength and associated utility.

FIG. 8(*a*) is a representative section view of a preferred embodiment of a mid-span bracket of the present invention taken at 8—8. Mid span bracket 160 is secured to upper rigid panel element 109, back rigid panel element 111 and to the floor or ground supporting the composite beam enclosure structure 100 with attachment means 170. Mid span bracket 160 has enhanced utility as the width 162 of upper rigid panel element 109 is increased and as the length of the cantilevered span portion 105 of the front rigid panel element 132 is increased. Such bracket 160 can be formed of any single or composite material, including metals, plastics, etc. bracket 160 is formed, in a preferred embodiment, of an outer square member 162 and an inner strengthening member 164. By securing bracket 160 to the ground support by screw 170, the entire structure is prevented from rotating, twisting, moving, etc. The square member 162 and the inner strengthening member 164 cooperate to form a rigid bracket 160 which is designed to resist any deformation or other structural instability due to the uneven loading of the cantilevered front panel element 132. This rigid span bracket 160 will also support upper panel element 109 due to top loading caused by placing objects thereon, children playing thereon, etc. Positioning of the mid span bracket 160 within the composite beam enclosure structure 100 as desired is possible, and utilizing two or more such brackets 160 will enhance rigidity and strength of the composite beam enclosure structure 100 and avoid deformation due to the cantilevered span 105 or due to external, outer surface 108 loading.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true spirit and scope of the invention.

We claim:

1. A composite beam enclosure structure comprising:

a plurality of planar, rigid panel elements each comprising a platform with a top and bottom surface and integral solid peripheral side edges, the panel elements having a plurality of intersecting ribs integral with and extending from the bottom surface of the platform, the side edges defining sectional configurations, the rigid panel elements each having an overall length and width;

a plurality of elongated, structural framing elements having integral opposing flanges spaced for receiving the side edges of one or more rigid panel elements; and means for securely attaching the plurality of structural framing elements to the side edges of the rigid panels, thereby coupling the panel elements together and forming an enclosure.

2. The composite beam enclosure structure of claim 1 comprising a front rigid panel element, an upper rigid panel element and a back rigid panel element, the plurality of elongated structural framing elements comprising (1) a first right angle, structural framing compression member coupled between the front rigid panel element and the upper rigid panel element and (2) a second right angle, structural framing compression member coupled between the back rigid panel element and the upper rigid panel element.

3. The composite beam enclosure structure of claim 2 further comprising two end plates, each end plate coupled to each of the plurality of rigid panel elements with one end plate at each of two lengthwise ends of the structure.

4. The composite beam enclosure structure of claim 3 in which the two end plates are rigid panel elements, each having a predetermined length and a predetermined width, the rigid panel elements each having a plurality of standing, intersecting ribs in a predetermined orientation and relationship with each other.

5. The composite beam enclosure structure of claim 1 in which the plurality of standing, intersecting ribs form a rectangular lattice structure.

6. The composite beam enclosure structure of claim 1 in which the plurality of standing, intersecting ribs form a triangular lattice structure.

7. The composite beam enclosure structure of claim 2 in which the sectional configuration of the front rigid panel element defines a suspended, transverse span portion between each of two lengthwise ends, the plurality of elongated structural framing elements further comprising a transverse span structural framing tension brace extending along the span portion of the front rigid panel element.

8. The composite beam enclosure structure of claim 2 in which the plurality of elongated structural framing elements further comprise a flanged tension footing extending along a lower edge of the back rigid panel element.

9. The composite beam enclosure structure of claim 2 further comprising at least one mid-span bracket secured to the enclosure structure supporting the upper rigid panel element and extending therefrom to the back rigid panel element.

10. The composite beam enclosure structure of claim 7 further comprising at least one mid-span bracket secured to the enclosure structure supporting the upper rigid panel element and extending therefrom to the back rigid panel element.

* * * * *